United States Patent [19]

Bolnberger et al.

[11] Patent Number: 4,718,415

[45] Date of Patent: Jan. 12, 1988

[54] BREATHING MASK HAVING A TRANSDUCER MOVABLE PARTS COUPLED TO A SPEAKING DIAPHRAGM FOR SPEECH TRANSMISSION

[75] Inventors: Reinhard Bolnberger, Vienna; Werner Fidi, Baden, both of Austria

[73] Assignee: AKG Akustische u.KinoGeräte Gesellschaft m.b.H., Austria

[21] Appl. No.: 899,746

[22] Filed: Aug. 21, 1986

Related U.S. Application Data

[63] Continuation of Ser. No. 686,205, Dec. 26, 1984, abandoned.

[30] Foreign Application Priority Data

Dec. 27, 1983 [AT] Austria ..... A 4533/83

[51] Int. Cl.[4] ..... A62B 7/14

[52] U.S. Cl. ..... 128/201.19

[58] Field of Search ..... 122/201.19; 179/184–188, 132

[56] References Cited

U.S. PATENT DOCUMENTS

| | | | |
|---|---|---|---|
| 2,123,196 | 7/1938 | Millard | 128/141 |
| 3,109,425 | 11/1963 | Gongoll et al. | 128/201.19 |
| 4,072,831 | 2/1978 | Joscelyn | 179/188 |
| 4,164,942 | 8/1979 | Beard et al. | 128/201.19 |
| 4,402,316 | 9/1983 | Gadberry | 128/201.19 |

FOREIGN PATENT DOCUMENTS

| | | |
|---|---|---|
| 737725 | 12/1932 | France . |
| 492664 | 3/1937 | United Kingdom . |
| 2081550 | 2/1982 | United Kingdom . |

*Primary Examiner*—Edward M. Coven

*Attorney, Agent, or Firm*—McGlew and Tuttle

[57] ABSTRACT

A breathing mask includes a carrier which has an inhalation passage and an exhalation passage and a passage over which a speaking diaphragm is extended for speech transmission from the interior of the mask to the exterior. In accordance with the invention an electrostatic transducer has a moving part which is coupled directly to the speaking diaphragm to provide for improved speech transmission.

1 Claim, 8 Drawing Figures

BREATHING MASK HAVING A TRANSDUCER MOVABLE PARTS COUPLED TO A SPEAKING DIAPHRAGM FOR SPEECH TRANSMISSION

This application is a continuation of application Ser. No. 686,205, filed Dec. 26, 1984, abandoned.

FIELD AND BACKGROUND OF THE INVENTION

This invention relates in general to a breathing mask construction and in particular to a new and useful means for transmitting speech from the interior of the mask to the exterior.

Several ways are known to effect speech transmission from protective breathing masks A known typical system is described in German OS No. 30 13 939 disclosing a microphone loudspeaker optionally usable for a breathing mask or a protective helmet. The microphone loudspeaker comprising an electroacoustic, preferably dynamic, transducer, is accommodated in a cup shaped housing which is detachably secured by its cylindrical edge to the rim of the exhaling valve housing of a mask, or to the chin piece of a helmet. The sole advantage of such an arrangement is that one and the same transducer system can be used both as a microphone and as a loudspeaker. A microphone loudspeaker, however, has always the drawback of a reduced transmission quality, for acoustic reasons. Further, the microphone receives only speech passing through the mask, which is thereby made considerably unintelligible. On the other hand, sound coming from the outside of the mask thus predominantly noise, such as from the exhaling valve, is received without attenuation or distortion. To obtain a satisfactorily intelligible sound, the antechamber of the exhaling valve must be designed as a Helmholtz resonator, with a resonance frequency at about 2,400 Hz, and another Helmholtz resonator must be provided having a resonance frequency of 3,000 Hz, to ensure a transmission at least up to 3,000 Hz.

The poor reproducing quality of microphone loudspeakers is due to the fact that the vibratory conditions of the diaphragm at the reception are different from those at the reproduction, and electrical measures are needed to balance the frequency response of the two transducers. Further, a diaphragm diameter of 3 to 4 cm, usual in such microphone loudspeakers, is not sufficiently responsive to low frequencies. The distortion factor of such small loudspeaker systems also is correspondingly high. This must be taken into account while appreciating the use of such a system under emergency conditions where intelligibility of speech is imperative and misunderstanding may be fatal.

Mentioned German OS No. 30 13 939 describes various devices making possible understanding between two persons. Mentioned are portable radio transmitters-receivers, compact transceivers, throat microphones, bone-conduction microphones, and microphones secured to the exhaling valve of the mask, which all have some disadvantages. For example, to handle a transmitter-receiver, the user must have one hand free, which may considerably hinder his activities. Or the arm carrying the microphone of a transceiver must be swung to the mouth region upon putting on a mask, since only there, the speech poorly intelligible through the mask can be received. The other mentioned systems have mostly insufficient acoustics and are inconvenient to carry, or have their speech signals to strongly affected by the ambient noise, particularly the operation of the valve of the mask.

In German OS No. 31 37 113, a helmet mask arrangement equipped with a contact microphone is mentioned, however, what is meant is a microphone such as described in German OS No. 30 13 939, directly picking up vibrations which occur on the head during the act of talking. From Austrian patent No. 342,129, a gas or smoke mask is known in which a microphone provided close to the mouth region within the facepiece of a gas mask is exposed to the sound waves produced by the speech. Since no speaking diaphragm is provided in this mask, the built-in microphone must be used also for close range communication. This may strongly reduce the possibility of understanding, since the microphone may come into direct contact with the user's cheek, quite aside from the acoustically unsatisfactory position of the microphone laterally of the mouth which strongly dampens the high frequencies substantially contributing to the intelligibility of spoken words.

German OS No. 31 27 677 discloses a speaking device for mask users providing a transmission arrangement which is secured at least to the outside of the mask and capable of producing an output signal corresponding to the voice of the mask user. The output signal may then be supplied to a loudspeaker carried on the user's body, to produce sound signals which are audible to persons present in the vicinity of the mask user. Evidently, this prior art device does not comprise a speaking diaphragm for close-range communication, it rather requires a complicated electroacoustic arrangement for this purpose. Aside therefrom, in the prior art device, the sound must penetrate through the material of the mask, which does by no means contribute to a distinct comprehension of what was spoken behind the mask. Also, the obtained result is certainly not adequate to the considerable costs of the construction.

German AS No. 17 08 045 describes a mask attachment comprising at least one exhaling valve and a speaking diaphragm. The diaphragm is intended for close-range communication only, and an inner mask is provided preventing the outside air from passing directly to the window, while the sound of speech is conducted to a speaking diaphragm and passes through an antechamber to the outside. With this arrangement, the sound cannot be transmitted over a longer distance.

SUMMARY OF THE INVENTION

The invention is directed to an improvement over the prior art, permitting a very high quality tranmission of human speech from a breathing mask with simple means, without transmitting at the same time disturbing noises from the ambience or from the mask itself, such as caused by the mask valve or by breathing. More particularly, in contradistinction to prior art designs, the inventive features are to increase the transmission level difference between the useful sound of the speech and any disturbing sound, to an extent making the noise no longer perceivable.

To this end the invention provides that in a mask equipped with a speaking diaphragm for transmitting speech to the outside, a movable part of an electroacoustic transducer is directly coupled to the speaking diaphragm.

The invention has the advantage that due to the coupling of the electroacoustic transducer to the speaking diaphragm of the mask, the transmission quality and intelligibility of the speech to be transmitted, is extraordinarily improved.

While speaking with a mask put on, the limited space between the face and the mask prevents a radiation field from building up at low and medium frequencies, so that the acoustic properties of a pressure chamber must be taken into account. The varying pressure produced within the mask by the speech is a multiple of the sound pressure measurable in the proximate radiation field, such as 5 cm in front of the mouth. Generally, the varying sound pressure will be by about 30 db higher within the mask than in the close range field. The varying sound pressure within the mask sets all parts of the mask capable of oscillation, particularly the speaking diaphragm, into corresponding vibrations which can then be converted, by means of proper sound receivers, into analog electrical signals. Because of the high sound pressure within the mask, this contributes to an extraordinarily high signal-to-noise ratio permitting to transmit the useful sound of the speech without disturbances.

According to the advantageous development of the invention the coupling between the movable part of the transducer and the mask parts set in vibrations can be released.

The possibility of removing the transducer from the mask has the advantage that if needed, the mask will be used without the transducer, or conversely, the transducer may be attached to the mask quickly and easily.

The speaking diaphragm is mounted in the mask in a position about 4 cm in front of the user's mouth and nose, and is to enable the user to communicate by speech with persons in the near vicinity. Such a communication of course is restricted, not least by the very unfavorable sound radiation of the speaking diaphragm itself. A considerably better transmission and satisfactory intelligibility can be obtained only if, in accordance with the invention, the speaking diaphragm is used as a pickup for the electroacoustic transducer which then converts the varying sound pressure within the mask into analog electrical signals. These analog electrical signals are supplied to an electronic communication system such as a radio or public address system, and can be received with an ear knob, headset, or through a loudspeaker. The advantage over the prior art is that the communication is almost disturbance free, undistorted, and thus is very intelligible.

According to another development of the invention, the electroacoustic transducer is designed as a moving coil microphone having its diaphragm applied directly to the speaking diaphragm of the mask. This is an ideal way of transmitting the oscillations of the speaking diaphragm to the diaphragm of the microphone, if care is taken to prevent any disengagement between the two diaphragms even at the highest practical frequencies. The advantage of this coupling is that the microphone is mounted on the mask outside and does not occupy any space within the mask. By simple acoustic means, such as an acoustic friction, the entire oscillatory system of speaking diaphragm and microphone may be adjusted within the range of about 50 Hz to 4,000 Hz to a linear flat response corresponding to a constant transmission factor in this region. Such a frequency response ensures a more than satisfactory intelligibility through the electronic communication system. Since the speech produces a high sound pressure level of about 120 db within the mask, the microphone itself must be very insensitive, even as compared to conventional microphones, to prevent overdriving of the electronic communication system by the electrical signal from the microphone. In other words, as measured in a free sound field, the microphone must be extremely insensitive and deliver at its electrical output a voltage which is by about 30 db lower than in any conventionally used moving-coil microphone. The high signal-to-noise ratio obtained for the speech from the mask, results therefrom. In general, when put on, the mask itself will partly attenuate noises from the outside. Noises produced within the mask, such as by the breathing valves, will in any case be attenuated by the 30 db and thus virtually inaudible.

In another embodiment of the invention, the speaking diaphragm of the mask may be connected to at least a part of the magnetic system of an electrodynamic transducer during its moving or flat coil fixed.

In such an arrangement, the speaking diaphragm of the mask is used simultaneously as a microphone diaphragm and united with the other parts of the moving coil transducer. This embodiment saves one microphone diaphragm while still providing a satisfactorily and flawlessly operating moving-coil microphone It has the advantage of the most simple manner of equipping a mask with, or securing thereto, a dynamic microphone for selective use with the mask.

However, the sound may be picked up from the oscillating speaking diaphragm also by coupling it rigidly to a piezoelectric transducer. The distinguishing feature of piezoelectric transducers is primarily their small size and weight.

Another sound pickup possibility is to couple the speaking diaphragm of the mask to an electrostatic transducer. With the present state of the art, such transducers can be manufactured in electret technique and miniturized, thus made very light and small, which makes them particularly suitable for detecting the oscillations of a speaking diaphragm.

Accordingly it is an object of the invention to provide a breathing mask which has an improved arrangement for the transmission of speech therethrough.

A further object of the invention is to provide a breathing mask having a transducer with a movable part coupled to a speaking diaphragm of the mask and which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 3:
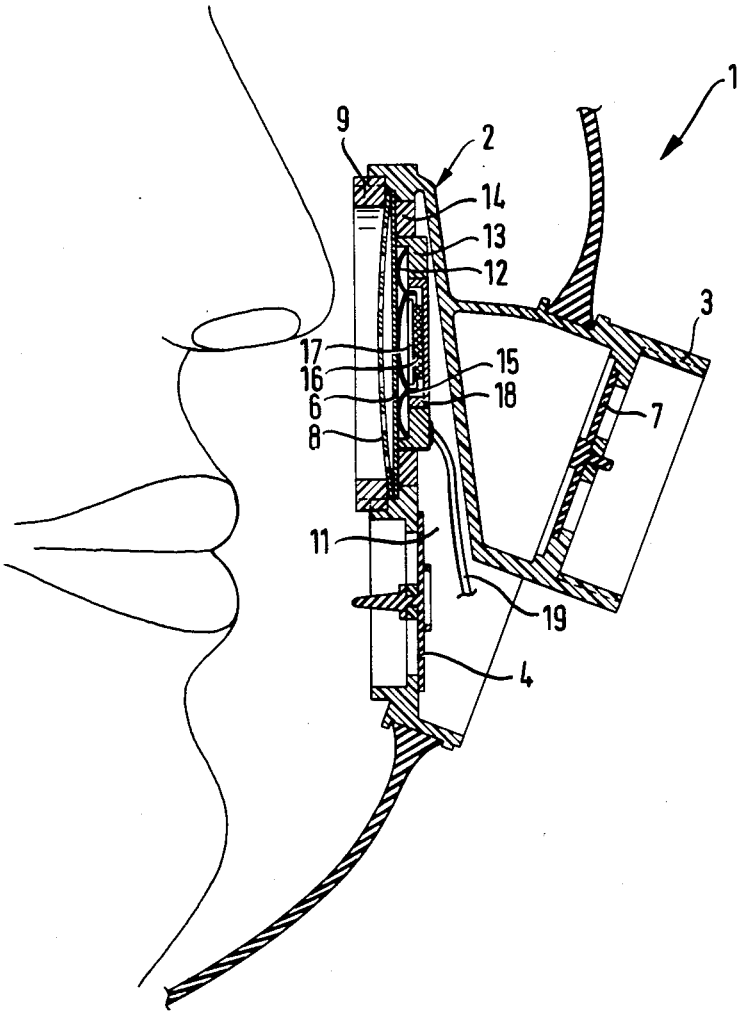
FIG. 3 is a similar view showing a dynamic transducer applied against the speaking diaphragm in accordance with the invention.

Referring to the drawings in particular the invention embodied therein comprises a breathing mask generally designated 1 which in accordance with the invention as indicated in FIG. 3 is provided with an inlet passage 3, with an inhaling valve 7 and an exhaling passage having an exhaling valve 4 which includes a electrodynamic transducer 13 which has a movable part coupled directly to a speaking diaphragm 6 which is stretched across a passage or opening in which it is mounted.

Figure 1:
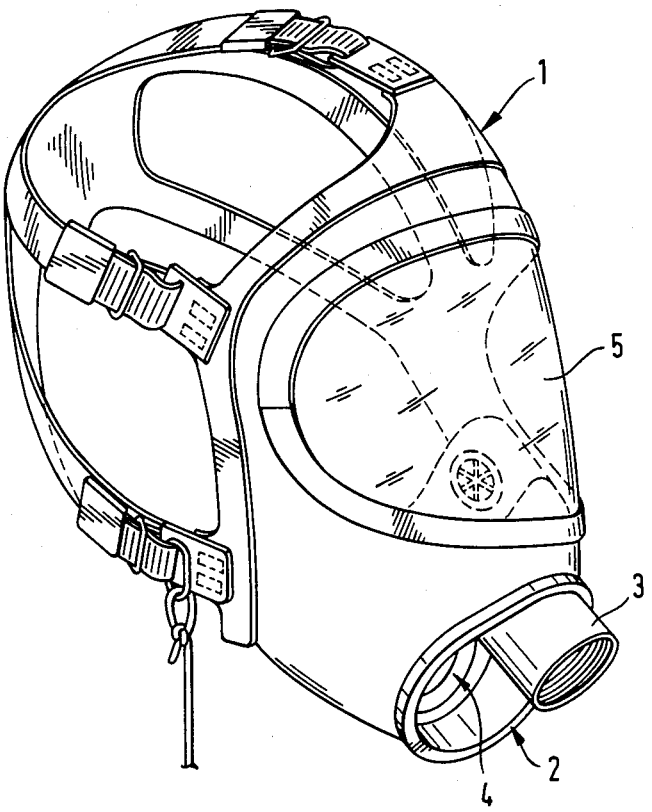
FIG. 1 is a perspective view of a conventional protective breathing mask.

FIG. 1 shows a conventional protective breathing mask comprising a rubber body 1 with a window 5, and a valve carrier 2. Behind an inhaling connection 3, a speaking diaphragm (not visible) is mounted in the valve carrier 2. Beneath inhaling connection 3 in which an inhaling valve is provided, an exhaling valve 4 is mounted.

Figure 2:
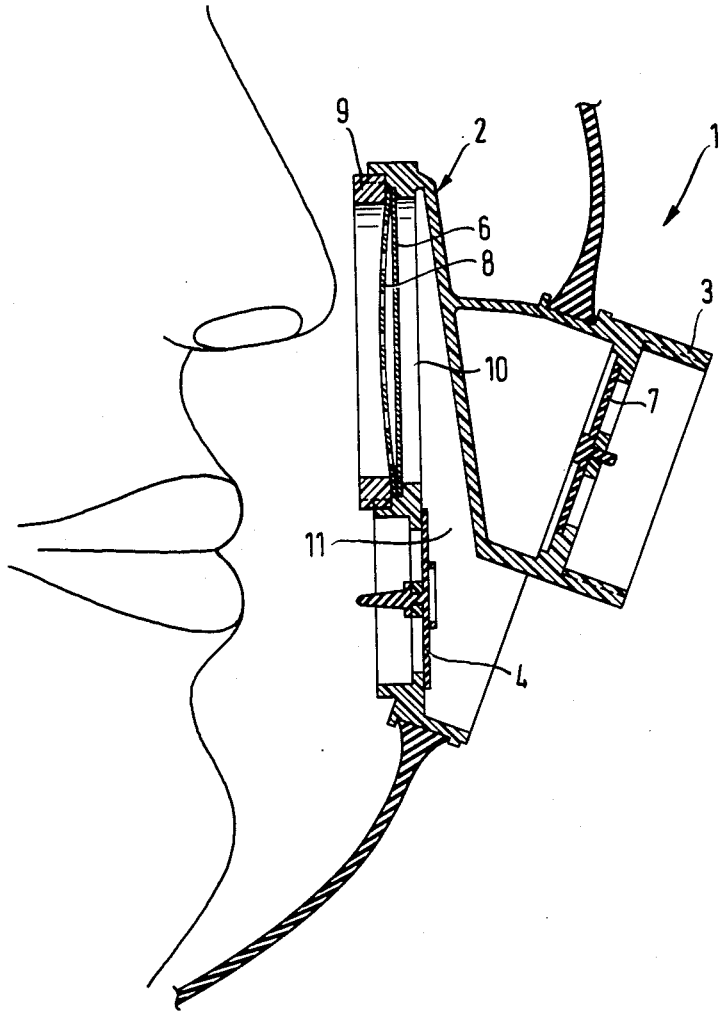
FIG. 2 is a sectional view of the carrier of the valve and a speaking diaphragm.

The sectional view of FIG. 2 shows the valve carrier 2, the speaking diaphragm 6, the inhaling connection 3 with the inhaling valve 7, and the exhaling valve 4. Speaking diaphragm 6 is protected against damaging by perforated protective cover 8 having a rim which is retained by a flange and a screw ring 9 which holds protective cover 8 and speaking diaphragm 6 in recess provided for this purpose. The sound pressure produced by the speech within the mask acts against speaking diaphragm 6 and causes oscillations thereof which are transferred to the air present in space 10 and propagate as soundwaves through a passage 11 to the outside.

FIG. 3 shows the inventive coupling of speaking diaphragm 6 to the transducer diaphragm 12 of an electrodynamic transducer 13 which is mounted on a supporting plate 14. Supporting plate 14 is in the form of a ring and is mounted in a circular recess of carrier 2. The circular recess is on the inner surface of a shoulder against which the speaking diaphragm 6 is held by the screw ring 9. The coupling between the two diaphragms 6 and 12 is effected by pressing the very rigid but still sufficiently resilient diaphragm 12 of the moving coil transducer 13 by its convex portion against speaking diaphragm 6, with the two diaphragms, however, remaining detachable from each other. The contact between the two diaphragms must make sure that at even the largest possible amplitudes of speaking diaphragm 6, transducer 12 will not disengage therefrom. The moving coil 15 oscillating in the annular air space of the magnetic system formed by magnet 16, pole plate 17, and soft iron cup 18 is rigidly secured to transducer diaphragm 12. By means of an electrical double line 19, the analog electrical signal is conducted to the outside. Line 19 may also be electrically screened.

Figure 4:
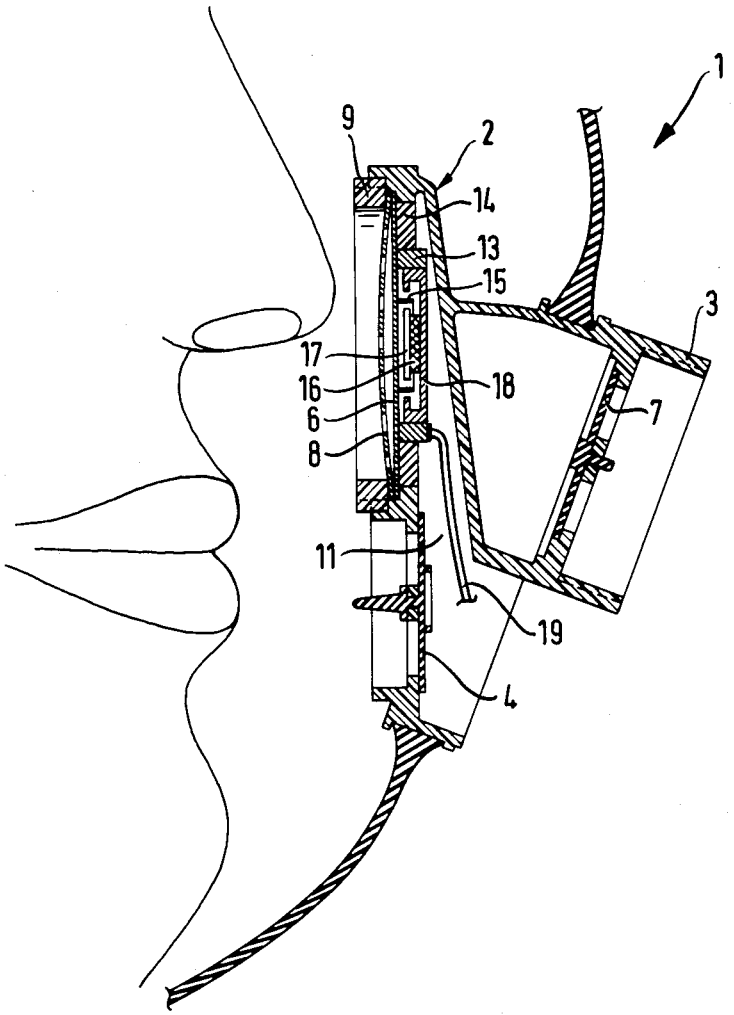
FIG. 4 is a similar view of another embodiment of the invention showing a moving coil mounted on the speaking diaphragm.

In another embodiment shown in FIG. 4, the moving coil 15 of an electrodynamic transducer 13 is directly rigidly and undetachably connected, by an adhesive, to speaking diaphragm 6. Speaking diaphragm 6 thus is an integral part of the dynamic transducer 13 whose magnetic system again comprises a magnet 16, a pole plate 17, and a soft iron cup 18, and which is connected to the outside through double line 19.

Figure 5:
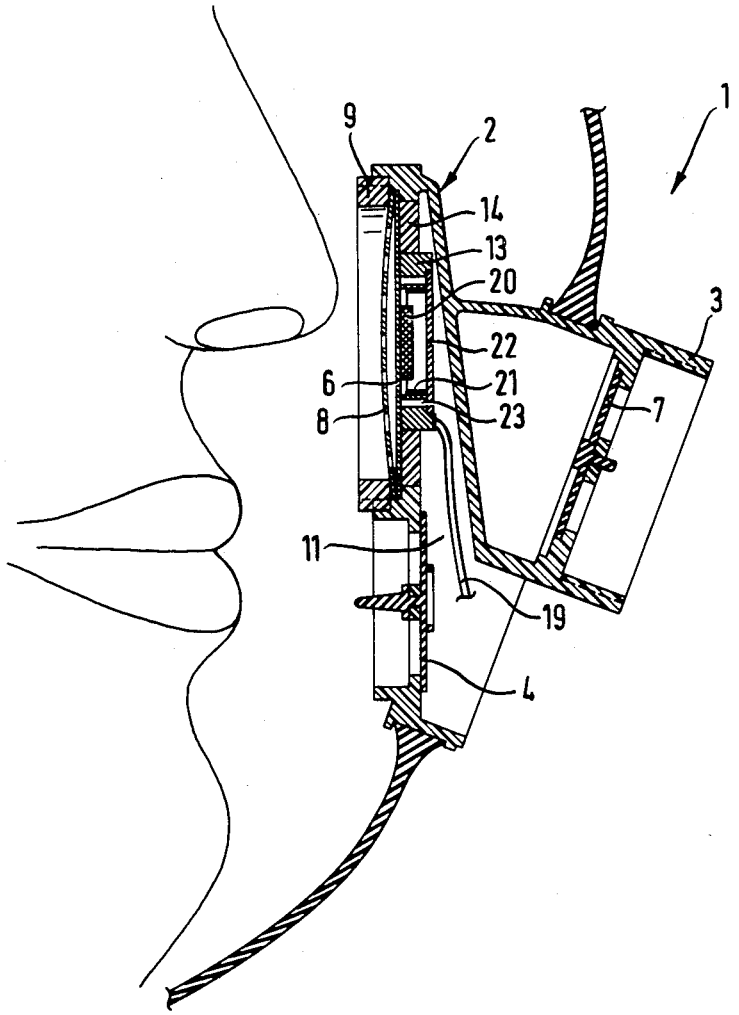
FIG. 5 is a similar view showing another embodiment with a permanent magnet secured to the speaking diaphragm.

The embodiment of FIG. 5 is an inversion of the moving coil transducer, in which magnet 20 is directly and rigidly connected by an adhesive to speaking diaphragm 6. Transducer 13 which is secured to retaining plate 14, comprises the non-movable coil 21 which is non-detachably connected thereto and in which a voltage analog to the speech signal is induced. By means of an acoustic friction 22, the oscillations of speaking diaphragm 6 are attenuated to an extent such that the required linear flat frequency response is obtained in the 50 Hz to 4000 Hz region. Through acoustic lines in the form of bores 23, the small-volume space behind the diaphragm communicates with the acoustic friction 22 leading to the outside. The electrical signals are conducted through a 2-pole line 19 which may be screened.

Figure 6:
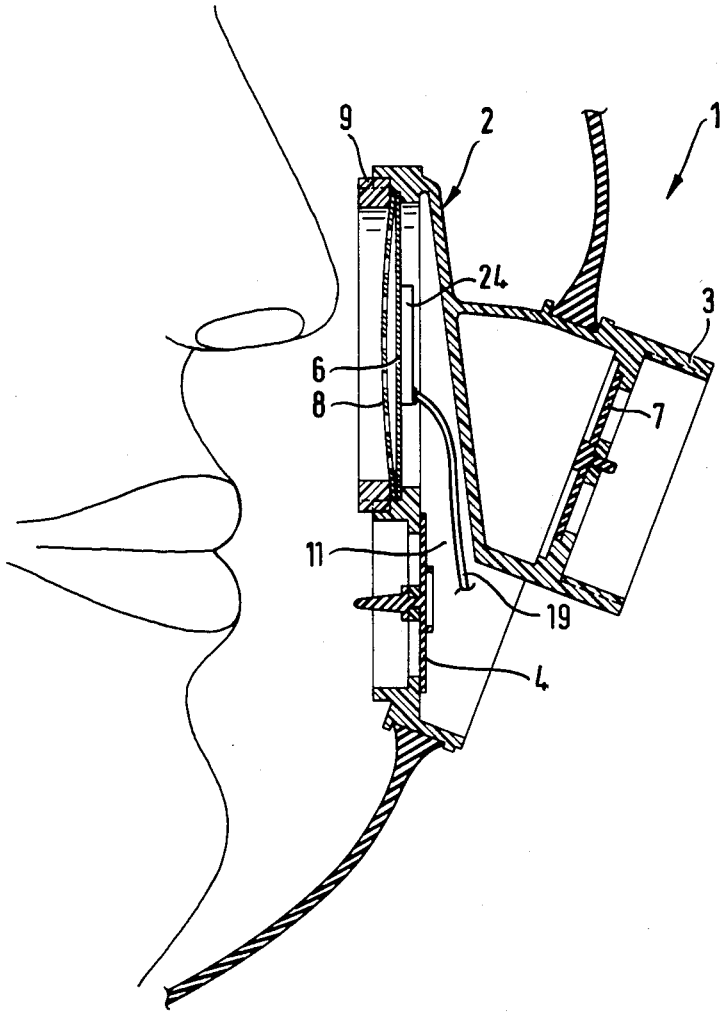
FIG. 6 is a similar view of another embodiment with a piezoelectric transducer rigidly mounted on the speaking diaphragm.

As shown in FIG. 6, the oscillations of speaking diaphragm 6 may be picked up by a piezoelectric transducer 24 which is rigidly and undetachably connected by an adhesive to the diaphragm 6. The electrical analog signal is again conducted to the outside through line 19.

Figure 7:
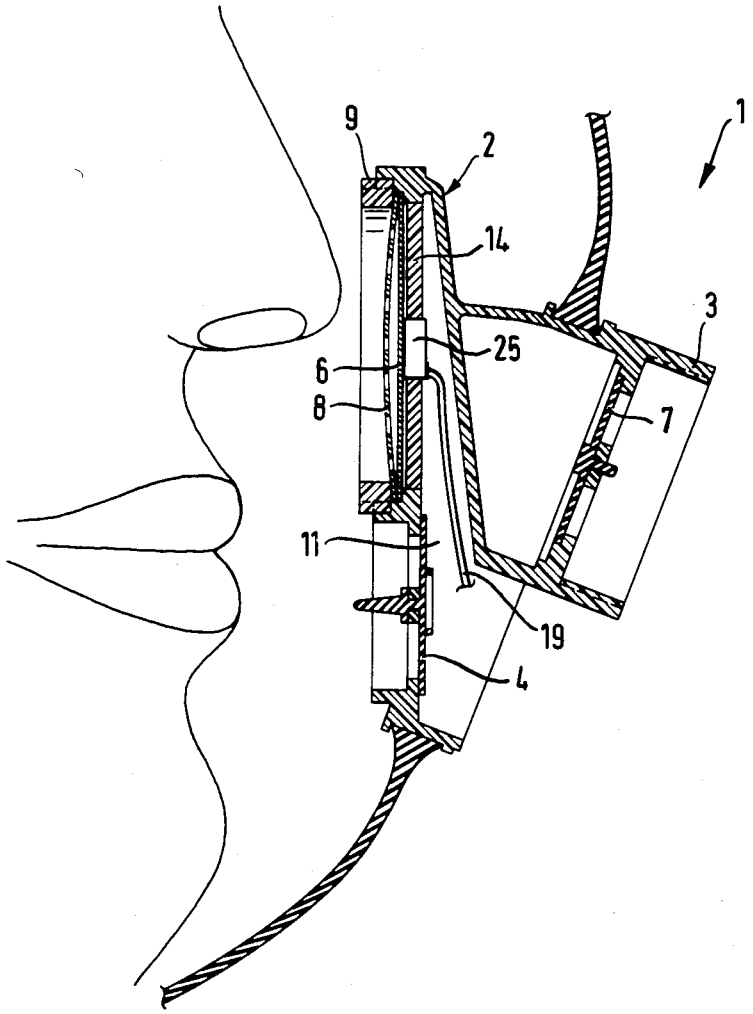
FIG. 7 is a similar view of another embodiment with an electrostatic transducer coupled to the diaphragm.

FIG. 7 shows a rigid solid coupling between speaking diaphragm 6 and an electrostatic transducer 25. To avoid the application of a polarizing voltage and thus save 2-pole lines, it will be advantageous to provide an electret transducer. A 2-pole screened line 19 conducts the analog electrical signal to the outside. The electrostatic transducer 25 in electret design is secured to retaining plate 14.

Figure 8:
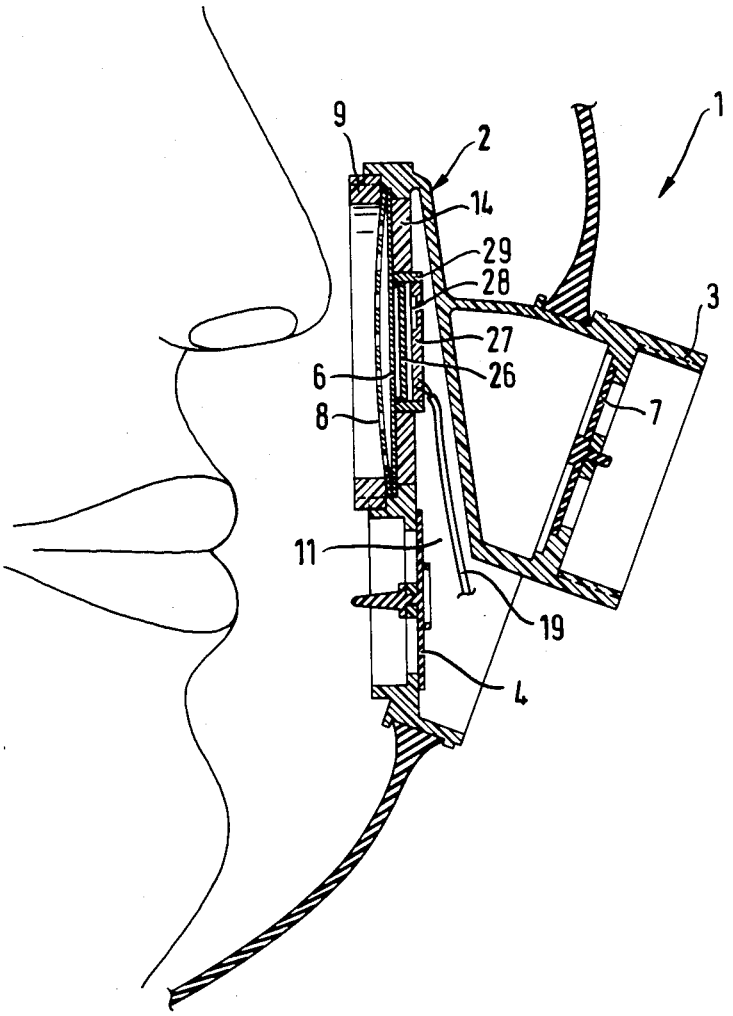
FIG. 8 is a similar view of another embodiment with the speaking diaphragm used as a sound pickup for an electrostatic transducer.

FIG. 8 shows an embodiment with an electrostatic transducer in which the speaking diaphragm itself forms the diaphragm of the transducer. Here again, a transducer may be used having its fixed counterelectrode made of an electret.

In a common housing 29, the resilient contacts for the electrical connection of the metallic speaking diaphragm, the counterelectrode, and, on a circuit board, a field effect transducer 28 as impedance transformer are provided. Housing 29 of the transducer is supported in retaining plate 14 and the electrical signal is delivered to the outside through a screened line 19.

While specific embodiments of the invention have been shown and described in detail to illustrate the application of the principles of the invention, it will be understood that the invention may be embodied otherwise without departing from such principles.

What is claimed is:

1. A breathing mask comprising a valve carrier (2) having a recess therein and an opening therethrough adjacent said recess, an exhaling valve (4) mounted to said valve carrier, an inhaling valve (7) mounted to said valve carrier, an electrodynamic transducer (13) connected to said valve carrier and extending across said opening, said transducer having a transducer diaphragm (12) extending across said opening and facing an interior of the breathing mask, a speaking diaphragm (6) having an outer rim engaged against said recess and being in direct contact with said transducer diaphragm for directly transmitting vibrations of said speaking diaphragm to said transducer diaphragm, and a screw ring (9) connected to said valve carrier and pressing said rim of said speaking diaphragm against said recess to urge said speaking diaphragm against said transducer diaphragm, said transducer diaphragm (12) having an inwardly convex portion which is engaged directly against said speaking diaphragm (6), and a perforated protective cover covering said speaking diaphragm on its side facing the interior of said breathing mask, said perforated protective cover having an outer rim engaged against said screw ring (9) and said rim of said speaking diaphragm.

* * * * *